US005915575A

United States Patent [19]

Morris, Sr.

[11] Patent Number: 5,915,575

[45] Date of Patent: Jun. 29, 1999

[54] SECURE LID AND OPEN HEAD CONTAINER ASSEMBLY FOR LIQUIDS

[75] Inventor: Glenn H. Morris, Sr., Chattanooga, Tenn.

[73] Assignee: M&M Industries, Inc., Chattanooga, Tenn.

[21] Appl. No.: 08/864,617

[22] Filed: May 28, 1997

[51] Int. Cl.[6] ..... B65D 55/02

[52] U.S. Cl. ..... 215/214; 215/216; 220/304; 220/323; 206/508

[58] Field of Search ..... 215/214, 216, 215/217, 330; 220/288, 304, 323, 326; 206/508

[56] References Cited

U.S. PATENT DOCUMENTS

| | | | |
|---|---|---|---|
| 1,232,741 | 7/1917 | West . | |
| 1,498,416 | 6/1924 | Willet . | |
| 2,084,568 | 6/1937 | White . | |
| 3,058,527 | 10/1962 | Dennis et al. . | |
| 3,181,718 | 5/1965 | Chancellor . | |
| 3,265,233 | 8/1966 | Tuuri | 215/214 X |
| 3,311,253 | 3/1967 | Pechacek . | |
| 3,648,876 | 3/1972 | Berman . | |
| 4,063,639 | 12/1977 | Grant . | |
| 4,245,753 | 1/1981 | Ellis . | |
| 4,732,288 | 3/1988 | Morris, Sr. . | |
| 4,967,926 | 11/1990 | Morris, Sr. . | |
| 4,978,004 | 12/1990 | Silverstein et al. . | |
| 5,052,576 | 10/1991 | Budenbender . | |
| 5,125,538 | 6/1992 | Morris, Sr. . | |
| 5,190,181 | 3/1993 | Budenbender . | |
| 5,207,341 | 5/1993 | Yeager | 215/334 |
| 5,207,345 | 5/1993 | Stewart et al. | 220/254 |
| 5,295,601 | 3/1994 | Bostelman . | |
| 5,377,858 | 1/1995 | Morris, Sr. . | |
| 5,452,748 | 9/1995 | Simmons et al. . | |
| 5,503,187 | 4/1996 | Simmons et al. . | |

*Primary Examiner*—Stephen K. Cronin

*Attorney, Agent, or Firm*—Birch, Stewart, Kolasch & Birch, LLP

[57] ABSTRACT

A threaded closure assembly includes a first member having an outer surface including a first outwardly directed thread, and an inner surface including a second inwardly directed thread. A unitary closure member for covering an access opening in the first member includes a first inwardly directed thread engageable with the first outwardly directed thread on the first member, and a second outwardly directed thread engageable with the second inwardly directed thread on the first member. A locking mechanism is provided between the closure member and the first member for permitting rotation of the closure member in a first direction, and preventing rotation of the closure member in a second opposite direction. A third set of threads may be provided between the first member and the closure member. The first member can be an open head container, with the closure member formed as a one-piece lid. The threads between the first member and the closure member are synchronized.

24 Claims, 7 Drawing Sheets

SECURE LID AND OPEN HEAD CONTAINER ASSEMBLY FOR LIQUIDS

BACKGROUND OF THE INVENTION

1. Field of the Invention

The present invention relates to a threaded closure assembly, and more particularly, to a open head container having a lid threadably securable thereto utilizing two or three sets of synchronized threads.

2. Description of the Background Art

Various open head container and lid assemblies are known in the art. For example, Applicant's prior U.S. Pat. No. 4,732,288, the entire contents of which are hereby incorporated by reference, discloses an open head container having a lid secured thereto by a single set of threads and wherein the lid includes a locking member for engaging with locking teeth provided on the container wall, to make the lid child-resistant. Further, Applicant's prior U.S. Pat. No. 4,967,926, the entire contents of which are hereby incorporated by reference, discloses a container having a lid securable thereto by a single set of threads, wherein the lid includes a pair of locking members engageable with teeth located on the inside of the container wall. Finally, Applicant's prior U.S. Pat. No. 5,125,538, the entire contents of which are hereby incorporated by reference, discloses an open head container having a closure attached to the open end of the container, and having a cap threadably secured to the container by a first set of threads, and to the closure by a second set of threads.

While these arrangements are useful for providing a child-resistant lid for an open head container, the strength of the threaded attachment of the lid to the container is limited. There exists a need in the industry to provide an open head container and lid assembly which can hold liquids as well as solid materials, and which can withstand the 48 inch drop test without failure to satisfy the United Nations' standards.

SUMMARY OF THE INVENTION

Accordingly, it is an object of the present invention to provide an open head container and lid assembly which is child-resistant.

It is a further object of the present invention to provide an open head container and lid assembly which can withstand the 48 inch drop test of the United Nations' standards without failure.

Yet another object of the present invention is to provide an open head container and lid assembly which includes a plurality of sets of synchronized threads to securely fasten the lid to the open head container.

Yet still another object of the present invention is to provide a threaded closure assembly having at least two sets of threads and a locking mechanism for covering an access opening.

These and other objects of the present invention are fulfilled by a threaded closure assembly having a first member, such as a container, defining an access opening, and a unitary closure member for covering the access opening. The first member includes a first outwardly directed thread engageable with a first inwardly directed thread on the closure member, and a second inwardly directed thread engageable with a second outwardly directed thread on the closure member. The closure member preferably includes a locking member engageable with a latch member on the first member to permit rotation in a first direction, and prevent rotation in an opposite direction.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
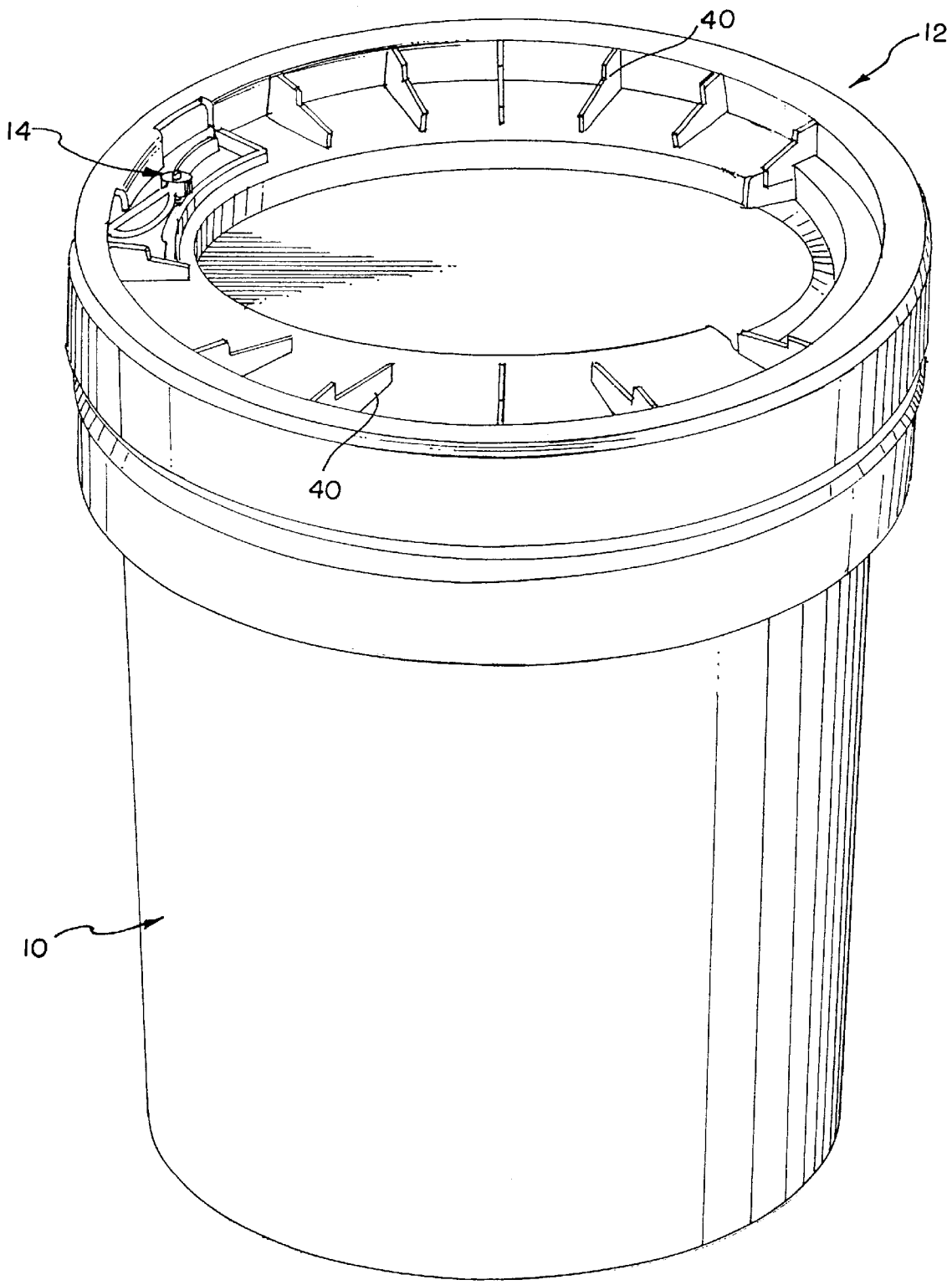
FIG. 1 is a perspective view of an assembled container with a latching mechanism.
Figure 2:
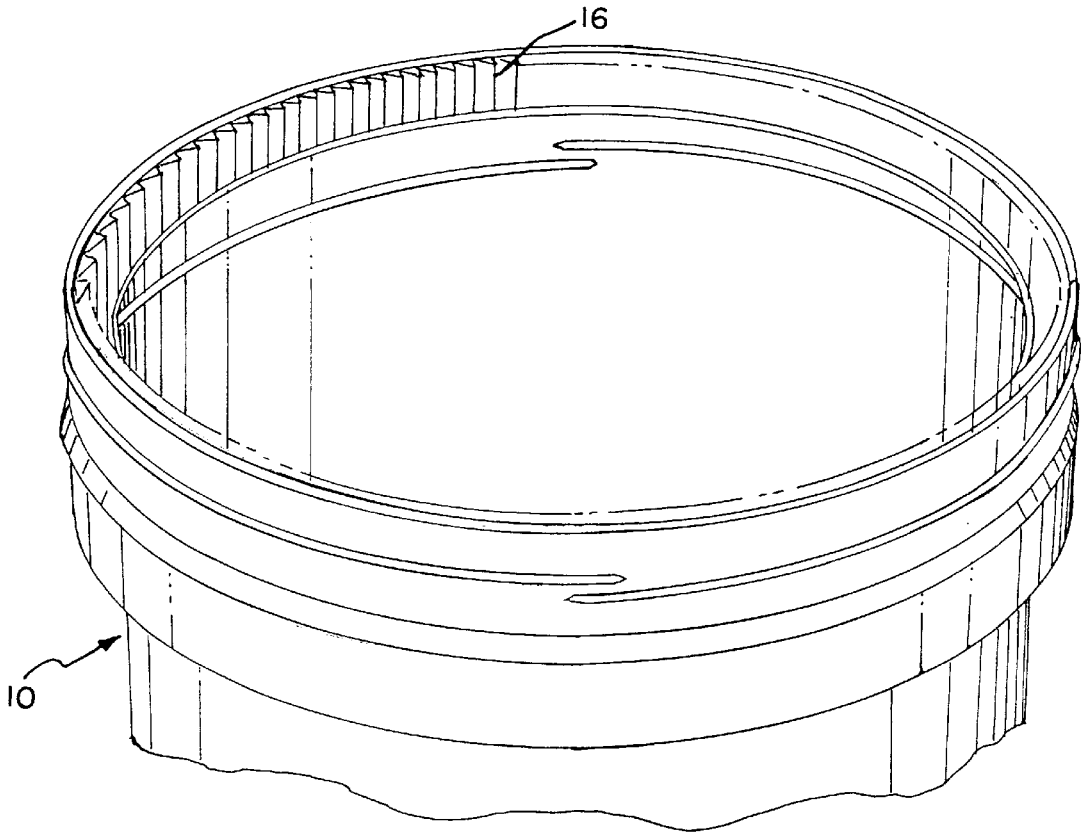
FIG. 2 is a partial perspective view of the container without the lid and showing the double synchronized thread and locking teeth.
Figure 4:
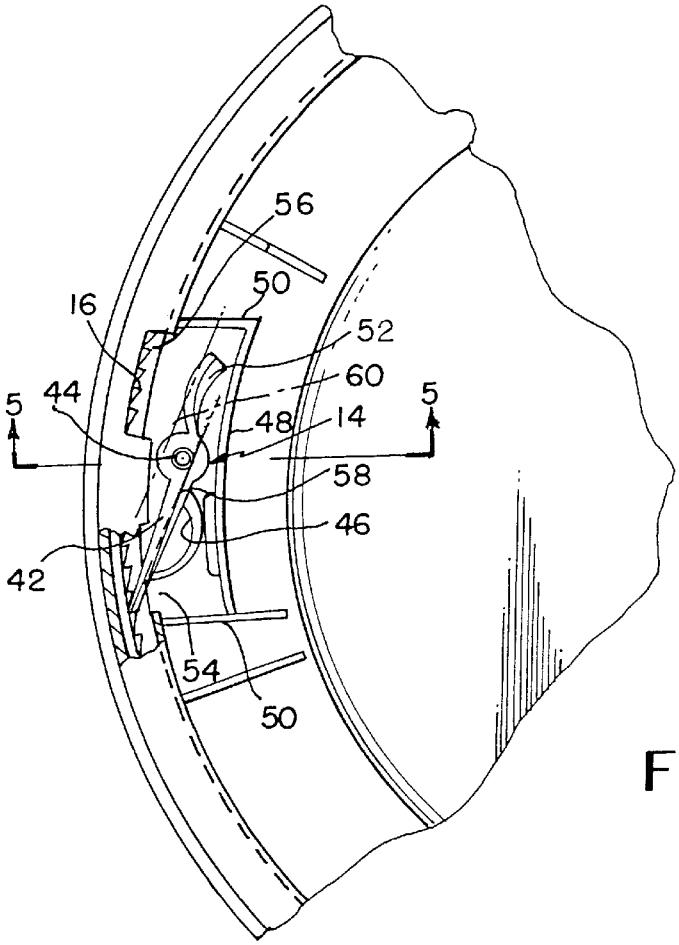
FIG. 4 is a plan view of a portion of the lid showing the details of the locking mechanism.

Referring in detail to the drawings and with particular reference to FIG. 1, an open head container 10 is shown. A lid 12 is threadably mounted to the open head container 10 adjacent the open end of the container 10. A resiliently biased locking member 14 is pivotally mounted to the lid 12, and cooperates with a plurality of teeth 16 on the container 10, as shown in FIGS. 2 and 4, for releasably locking the lid 12 to the container 10. The locking member 14 is configured to provide a child-resistant mechanism to prevent the lid 12 from being removed from the container 10 unless the locking member 14 is properly manipulated. It should be understood that although only one locking mechanism is shown in the figures, a second locking mechanism may be provided on the lid 12.

Figure 3:
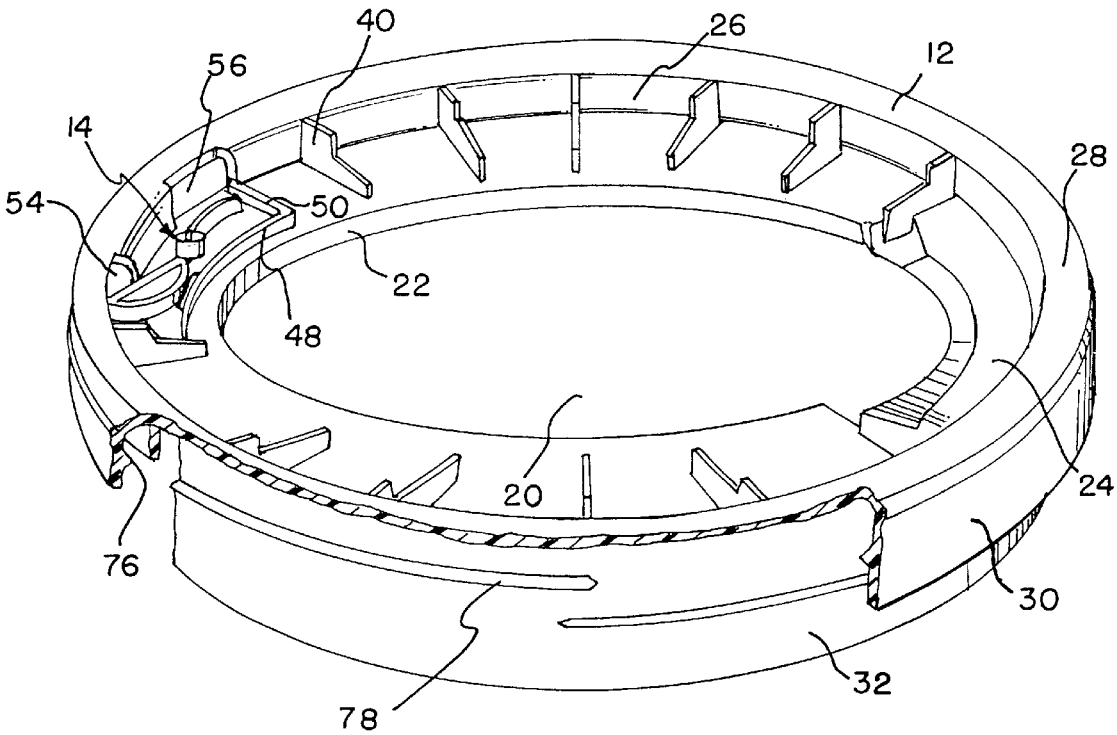
FIG. 3 is a perspective view of a lid including a locking mechanism, with a portion of the outer rim broken away to reveal the internal thread.
Figure 5:
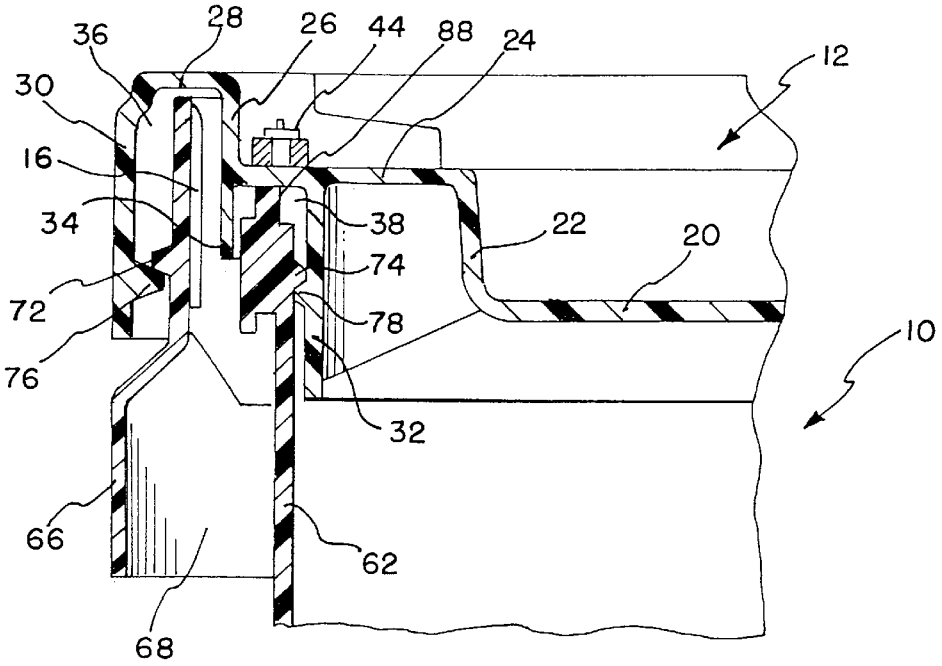
FIG. 5 is a fragmentary sectional view through the container and lid showing two sets of threads.

The details of the construction of the lid 12 are illustrated in FIGS. 1, 3 and 5, where it will be seen that the lid 12 comprises a central disk member 20, to which a first upwardly extending wall member 22 is attached. An upper wall member 24 is attached to the top of the first upwardly extending wall member 22 and extends radially outwardly therefrom. A second upwardly extending wall member 26 is connected with the upper wall member 24 at a radially outwardly directed edge portion thereof. A top wall 28 is connected to the upper end of the second upwardly extending wall member. 26 and is directed radially outwardly therefrom.

An outer wall 30 extends downwardly from an outer edge of the top wall 28. An inner wall 32 extends downwardly from a portion of the upper wall member 24. An intermediate wall 34 extends downwardly from the junction between the upper wall member 24 and the second upwardly extending wall member 26. An outer annular space 36 is formed between the outer wall 30 and the intermediate wall 34. An inner annular space 38 is formed between the inner wall 32 and the intermediate wall 34. The lid 12 as described above is formed as a one-piece unitary member, preferably of molded plastic.

A plurality of circumferentially spaced, radially extended gusset walls 40 are integrally connected between the upper wall member 24 and the second upwardly extending wall member 26 to reinforce the lid 12. The upper portions of the gusset walls 40 are configured to receive the bottom of an adjacent container stacked thereon. In addition to providing a stable socketing mechanism for receiving the lower end of an adjacent container, the gusset walls 40 are elevated from the upper wall member 24 so that the bottom wall of an adjacent container stacked thereon does not contact and damage the locking member 14.

The construction and operation of locking member will now be explained with particular attention directed to FIG. 4, wherein it will be seen that the locking member 14 includes a lever arm 42 offset from a pivot connection 44 and extending in a direction toward the container teeth 16. The lever arm 42 includes a substantially arcuate or elliptical spring member 46 which is adapted to engage a portion of the annular wall 48 extending between inwardly extending wall members 50, to thereby bias the lever arm 42 in a locking direction toward, and into locking engagement with, the container teeth 16. The elliptical spring member 46 is preferably. molded of plastic material integral with the locking member 14.

The locking member 14 is provided with a thumb engaging portion 52 integrally connected to the lever arm 42 and positioned on the opposite side of the pivotal connection 44, and offset to the opposite side of the pivotal connection 44 from the lever arm 42. By this construction and arrangement, when the thumb engaging portion 52 is pushed to move the lever arm 42 in a counter-clockwise direction as viewed in FIG. 4, the free end of the lever arm 42 is moved from locking engagement with the container teeth 16.

The second upwardly extending wall member 26 of the lid 12 in the vicinity of the locking member 14 is provided with a pair of openings or cut-outs 54 and 56 for accommodating the movement of the lever arm 42 toward and away from the container teeth 16, and a corresponding movement of the thumb engaging portion 52. The offset lever arm 42 and offset thumb engaging portion 52, on opposite sides of the pivot connection 44, are substantially parallel to each other, and lie closely adjacent to the second upwardly extending wall member 26. A longitudinal axis 58 of the lever arm 42, and a longitudinal axis 60 of the thumb engaging portion 52 are disposed at acute angles to the second upwardly extending wall, member 26 and the circumference of the lid 12.

Since the locking member 14 is so close to the second upwardly extending wall member 26 of the lid 12, the diameter of the bottom of an adjacent container stacked thereon is not unduly restricted for stacking on top of the lid 12 on the gusset walls 40. The two openings or cutouts 54 and 56 allow the locking member 14 to be positioned as closely as possible to the second upwardly extending wall member 26 of the lid 12.

The construction of the open head container 10 will now be described in detail. The open head container includes a main body member 62 having an open end or access opening 64. The main body member 62 may have an inner diameter which remains essentially constant from the open end 64 to the bottom wall 70, or the inner diameter may increase or decrease progressing toward the bottom wall 70 to form an open head container having inclined side walls.

An annular skirt member 66 encircles at least a portion of the main body member 62 adjacent the open end 64 of the container 10. The annular skirt member 66 is spaced from the upper end of the container 10 such that a gap is formed between the annular skirt member 66 and the main body member 62.

Figure 12:
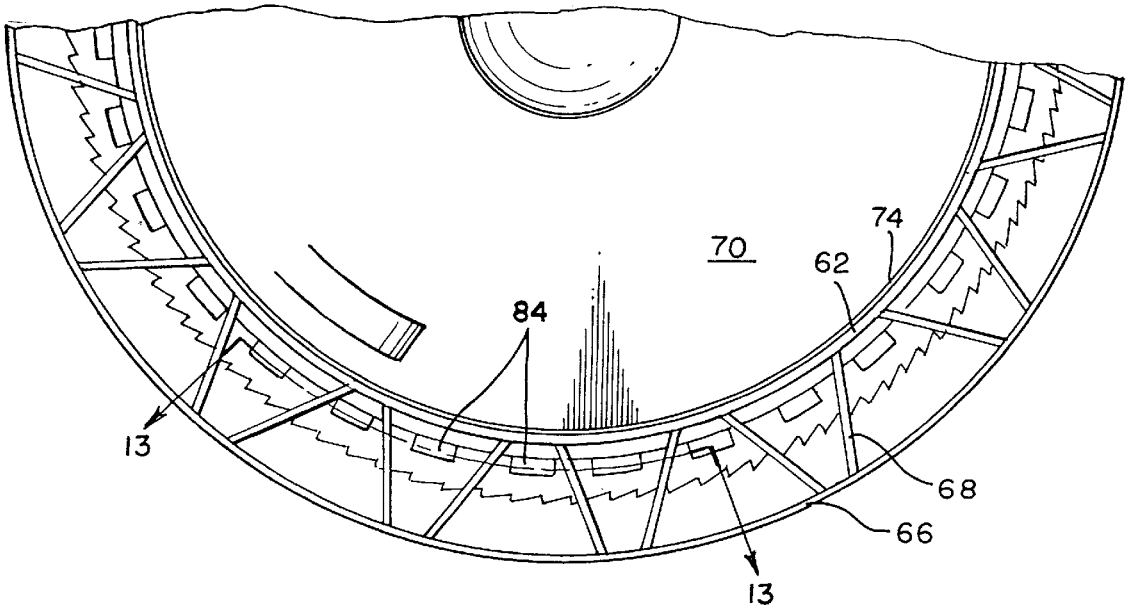
FIG. 12 is a bottom view of the open head container showing the interrupted or segmented threads arranged between the plurality of webs.
Figure 13:
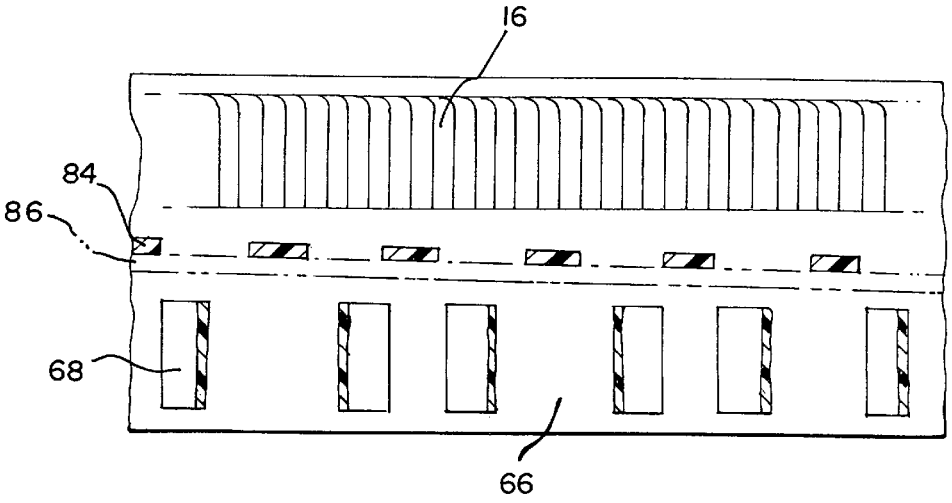
FIG. 13 is a sectional view taken along line 13—13 of FIG. 12.

A plurality of webs 68 interconnect the main body member 62 to the annular skirt member 66. The webs may extend radially outwardly from the main body member 62, or may extend outwardly from the main body at an angle inclined with respect to the radial direction, as shown in FIG. 12. Alternatively, the plurality of webs 68 may be replaced by a single disk encircling the main body member 62, and interconnecting the main body member 62 with the annular skirt member 66.

Figure 6:
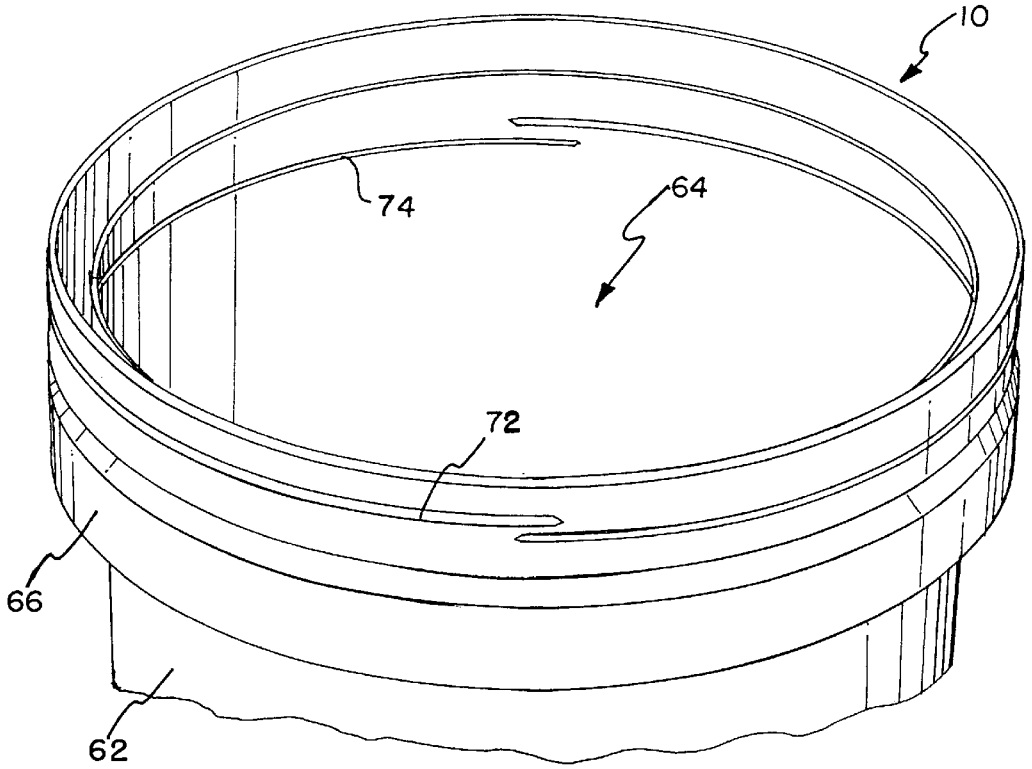
FIG. 6 is a partial perspective of the open head container without the locking teeth.

The arrangement of the threaded connection between the lid 12 and the open head container 10 will now be described in detail. As shown in FIGS. 5 and 6, an outer surface of the open head container 10 includes a first outwardly directed thread 72. The first outwardly directed thread 72 is preferably located on an outer surface of the annular skirt member 66. However, the open head container 10 may be configured without the annular skirt member 66, in which case the first outwardly directed thread 72 may be located on an outer surface of the main body member 62. A second inwardly directed thread 74 is located on an inner surface of the main body member 62.

The lid 12 includes a first inwardly directed thread 76 located on an inner surface of the outer wall 30. This first inwardly directed thread 76 is threadably engageable with the first outwardly directed thread 72 on the annular skirt member 66. A second outwardly directed thread 78 is located on an outer surface of the inner wall 32 of the lid 12. The second outwardly directed thread 78 is threadably engageable with the second inwardly directed thread 74 on the inner surface of the main body member 62. The first and second sets of threads 72, 76 and 74, 78 are synchronized such that rotation of the lid 12 in the right hand or clockwise direction enables both the inwardly and outwardly directed threads 76, 78 on the lid 12 to travel along and engage respective mating outwardly and inwardly directed threads 72, 74 on the container 10.

It should be apparent that in some applications, the use of left hand threads and/or multiple parallel threads may be utilized.

Figure 11:
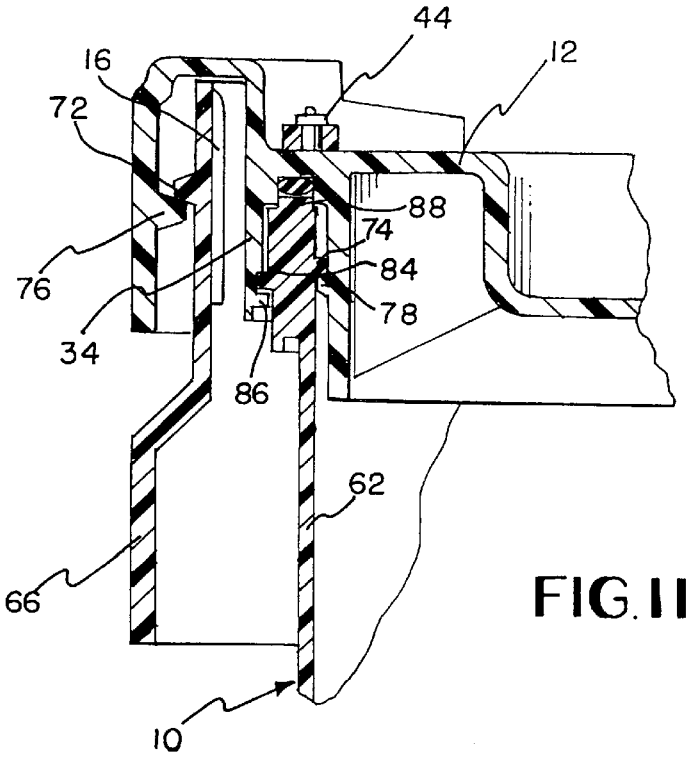
FIG. 11 is a cross-sectional fragmentary view through an assembled lid and container showing a third set of segmented threads arranged on an outer surface of the container body.
Figure 10:
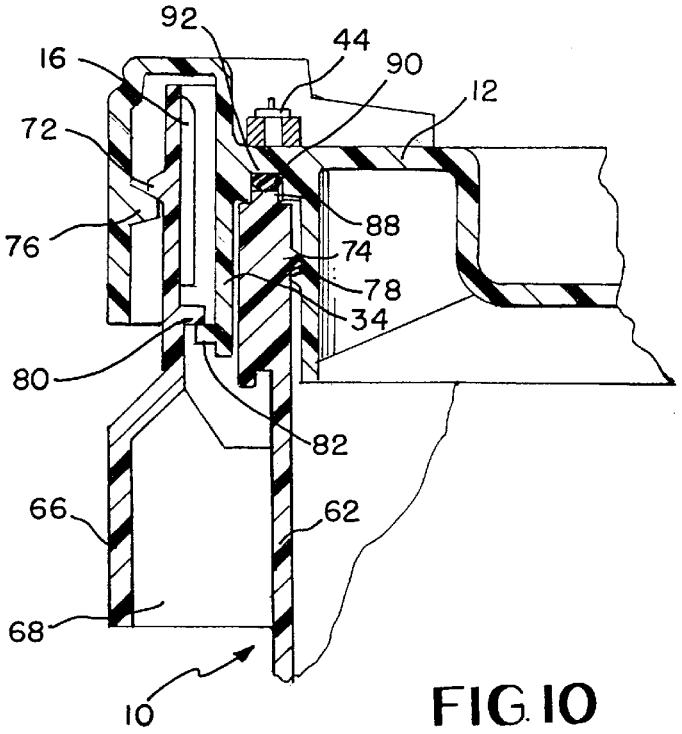
FIG. 10 is a cross-sectional fragmentary view through an assembled lid and container, showing a triple thread arrangement, with the segmented threads arranged on an inner surface of the skirt member.

Referring now to FIGS. 10 and 11, a third set of threads may be located between the lid 12 and the container 10. As shown in FIG. 10, the third set of threads may comprise a third inwardly directed segmented thread 80 located on an inner surface of the annular skirt member 66 which is threadably engageable with a third outwardly directed thread 82 located on an outer surface of the intermediate wall 34 of the lid 12. Alternatively, as shown in FIG. 11, an outer surface of the main body member 62 may include a third outwardly directed segmented thread 84 which is threadably engageable with a third inwardly directed thread 86 located on an inner surface of the intermediate wall 34 of the lid 12. The third set of threads is synchronized with the first and second sets of threads, in the manner discussed above.

Figure 9:
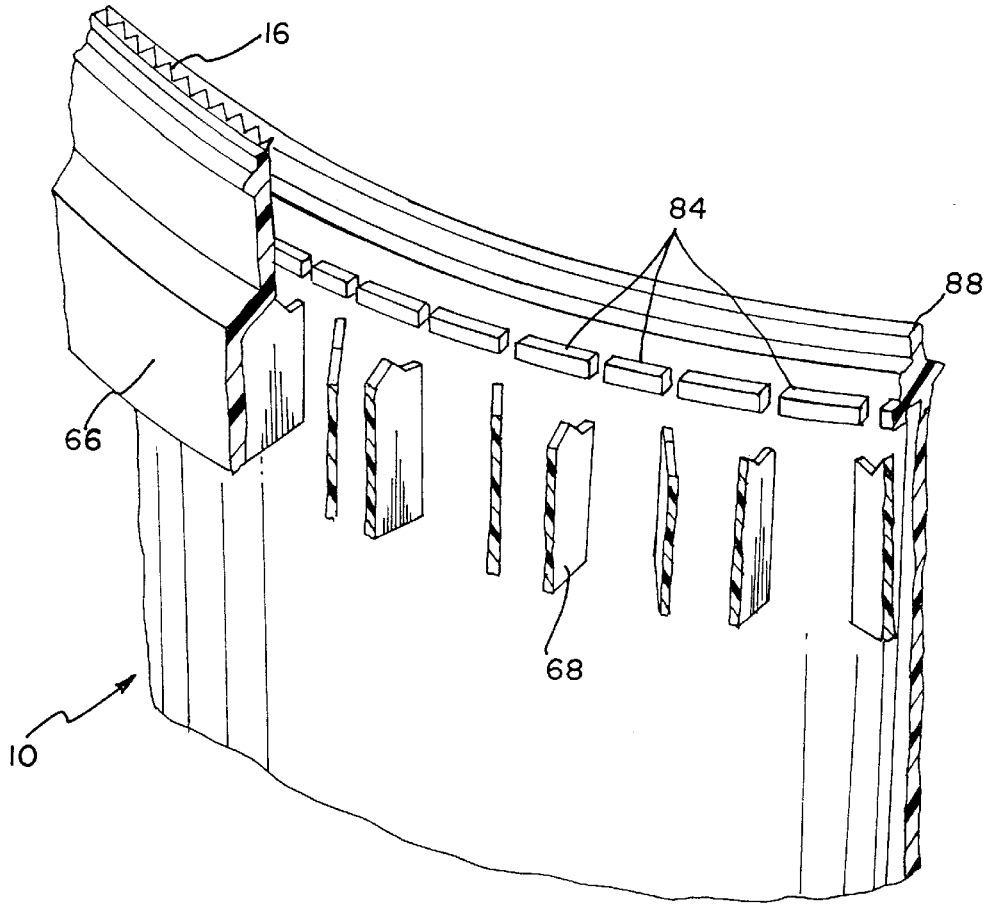
FIG. 9 is a partial perspective view of a segment of the open head container with a portion of the skirt member broken away.

The third outwardly directed segmented thread 84 may be more clearly seen in FIGS. 9 and 12. The third outwardly directed segmented thread 84 operates in the usual manner as threads 72 and 74. However, portions of the thread directly above the webs 68 are cut away such that a plurality of segmented threads are formed.

The container is preferably formed of molded plastic. The segmented thread construction allows upper and lower molds to more easily form the webs 68 and segmented thread 84, since the portion of a mold which forms the upper portion of the webs 68 may move past the segmented thread 84 in the gaps between adjacent ones of the segmented threads 84.

Tapered threads have been shown in the above embodiments due to their fluid sealing characteristics. However, it should be understood that various types of threads may be utilized, such as straight or square threads without departing from the spirit of the present invention.

The sealing arrangement between the container 10 and the lid 12 will now be described with reference to FIGS. 5, 10 and 11. As shown in FIG. 5, the upper portion of the main body member 62 has a reduced thickness wall section 88. The upper edge of the reduced thickness wall section may engage the under surface of the upper wall member 24 to assist in providing a seal between the lid 12 and the container 10.

Alternatively, an O-ring 90 may be located in an annular recess 92 in the under surface of the lid 12, as shown in FIGS. 10 and 11. Thus, the upper edge of the reduced thickness wall section 88 would engage the O-ring 90 to provide a positive fluid seal between the container 10 and the lid 12. The O-ring 90 is preferably formed of a resilient material such as rubber.

To further promote a sealing arrangement, as shown in FIG. 5, the inner annular space 38 may include a resilient sealing material for engagement with the upper edge and the inner and outer side edges of the reduced thickness wall section 88. The reduced thickness wall section 88 reduces friction between the lid 12 and the container 10 to make it easier to threadably attach the lid 12 to the container 10.

Figure 7:
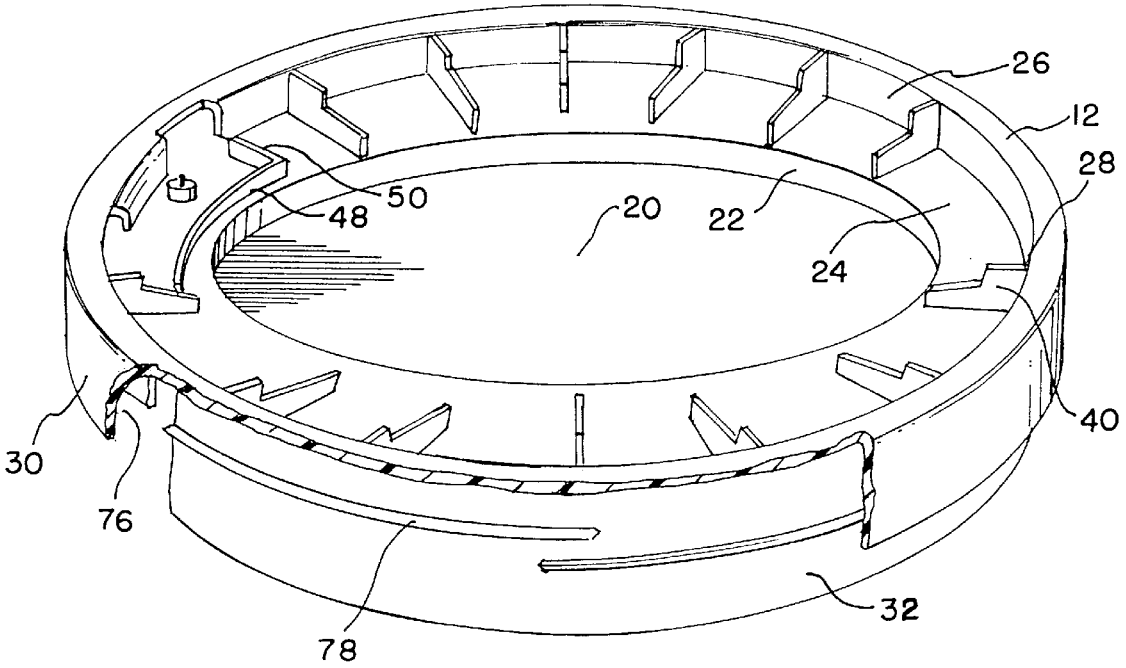
FIG. 7 is a perspective view of a lid without the locking mechanism, with a portion of the outer rim broken away to reveal the internal thread.
Figure 8:
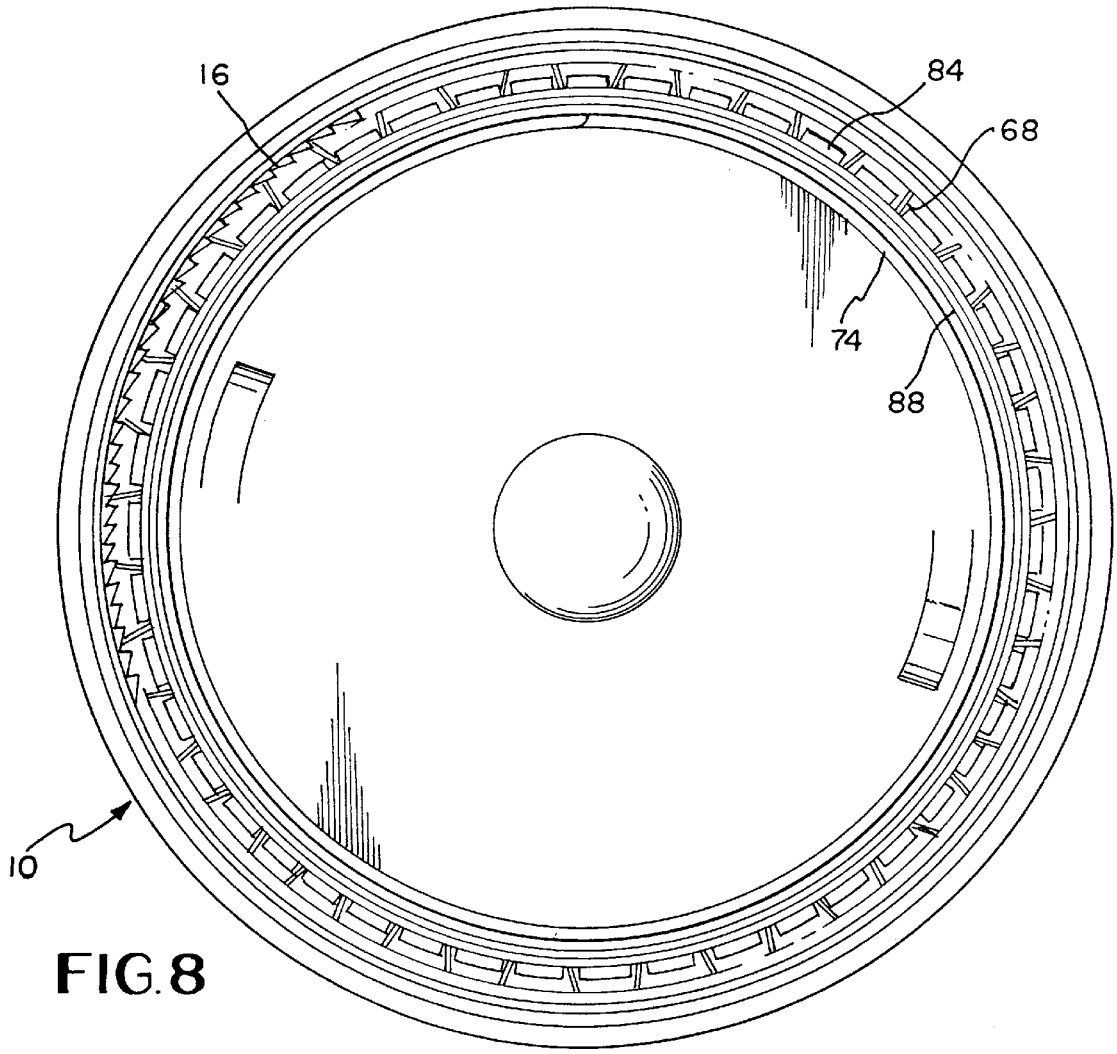
FIG. 8 is a plan view of the open head container with the lid removed, showing the interrelationship between a third set of segmented threads and a plurality of webs connecting a skirt member to the open head container body.

Although in a preferred embodiment, the container assembly is configured to include a child-resistant locking mechanism, FIGS. 6 and 7 show a container assembly which does not include the locking arrangement. The upper interior edge of the container 10 shown in FIG. 6 does not include the locking teeth 16 shown in FIG. 2. Similarly, the lid 12 shown in FIG. 7 does not include the resiliently biased locking member 14 shown in FIG. 3. However, the remaining details of the present invention discussed above would be equally applicable to a container arrangement which does not include the locking arrangement.

Further, although the present invention has been described with reference to use with an open head container 10, it should be understood that the present invention is not limited to use with a container, but is instead applicable to any threaded closure assembly for covering an access opening in a first member. Such threaded closure assemblies may include pressure caps, pipe caps, boiler plugs, casing tops, etc.

Still further, the third set of threads 80,82 shown in FIG. 10 may be simultaneously used with the third set of threads 84,86 shown in FIG. 11, to produce a container and lid assembly having four sets of synchronized threads.

Regarding the configuration of the resiliently biased locking member 14, it should be understood that other shapes and arrangements of locking members may be utilized, such as the arrangement of the locking member shown in U.S. Pat. No. 4,732,288.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A threaded closure assembly comprising:

a first member defining an access opening, said first member having:

an outer surface including a first outwardly directed thread;

an inner surface including a second inwardly directed thread; and at least one latch member; and a unitary closure member for covering said access opening, said closure member having:

a first inwardly directed thread engageable with said first outwardly directed thread on said first member;

a second outwardly directed thread engageable with said second inwardly directed thread on said first member; and a locking member for releasably engaging said latch member, said locking member permitting rotation of said closure member with respect to said first member in a first direction of rotation, and preventing rotation of said closure member with respect to said first member in a second opposite direction of rotation.

2. The threaded closure assembly according to claim 1, wherein said first member comprises a main body member and an annular skirt member spaced from and encircling a portion of said main body member.

3. The threaded closure assembly according to claim 2, wherein the first outwardly directed thread is located on said skirt member, and said second inwardly directed thread is located on said main body member.

4. The threaded closure assembly according to claim 2, wherein said skirt member includes a third inwardly directed thread, and wherein said closure member includes a third outwardly directed thread engageable with said third inwardly directed thread on said skirt member.

5. The threaded closure assembly according to claim 2, wherein the latch member comprises a plurality of teeth located on an inner surface of the skirt member.

6. The threaded closure assembly according to claim 2, further comprising a plurality of webs connecting said main body member to said skirt member.

7. The threaded closure assembly according to claim 1, wherein said first member includes a third outwardly directed thread, and wherein said closure member includes a third inwardly directed thread engageable with said third outwardly directed thread on said first member.

8. The threaded closure assembly according to claim 7, wherein said third outwardly directed thread on said first member is segmented and discontinuous.

9. The threaded closure assembly according to claim 1, wherein the first inwardly directed thread on said closure member is non-rotatable with respect to said second outwardly directed thread on said closure member.

10. The threaded closure assembly according to claim 1, wherein the locking member includes a lever arm pivotally attached to said closure member and extending in a direction toward said latch member, and a spring for biasing a portion of the lever arm into engagement with said latch member when said closure member is assembled with said first member.

11. The threaded closure assembly according to claim 1, wherein an upper portion of said first member has a reduced thickness wall section, and wherein said closure member further includes an annular seal for engagement with an upper edge of said reduced thickness wall section of said first member when said closure member is assembled with said first member.

12. The threaded closure assembly according to claim 1, wherein the first member is an open head container.

13. The threaded closure assembly according to claim 1, wherein the first inwardly directed thread on said closure member is synchronized with said second outwardly directed thread on said closure member.

14. The threaded closure assembly according to claim 1, wherein the closure member is a one-piece lid.

15. A container assembly comprising:

a container member including a main body member having an open end, said container member further including an annular skirt member spaced from and encircling at least a portion of said main body member adjacent said open end, said skirt member having an outer surface including a first outwardly directed thread, said main body member including a second inwardly directed thread;

a lid for closing said open end of said main body member, said lid including a first inwardly directed thread engageable with said first outwardly directed thread on said skirt member, and a second outwardly directed thread engageable with said second inwardly directed thread on said main body member;

a latch member located on an inner surface of the skirt member; and a locking member located on said lid for releasably engaging said latch member, said locking member permitting rotation of said lid with respect to said container member in a first direction of rotation, and preventing rotation of said lid with respect to said container member in a second opposite direction of rotation.

16. The container assembly according to claim 15, wherein the latch member comprises a plurality of teeth provided on an inner surface of said skirt member, and wherein the locking member includes a lever arm pivotally attached to said lid and extending in a direction toward said plurality of teeth, said locking member including a spring for biasing a portion of the lever arm into engagement with respective ones of said teeth when said lid is assembled with said container member.

17. The container assembly according to claim 15, wherein said main body member includes a third outwardly directed thread, and wherein said lid includes a third inwardly directed thread engageable with said third outwardly directed thread on said main body member.

18. The container assembly according to claim 15, wherein said skirt member includes a third inwardly directed thread, and wherein said lid includes a third outwardly directed thread engageable with said third inwardly directed thread on said skirt member.

19. The container assembly according to claim 15, wherein an upper portion of said main body member has a reduced thickness wall section, and wherein said lid further includes an annular seal for engagement with an upper edge of said reduced thickness wall section of said main body member when said lid is assembled with said main body member.

20. The container assembly according to claim 15, wherein the first inwardly directed thread on said lid is synchronized with said second outwardly directed thread on said lid.

21. The container assembly according to claim 15, wherein said lid is a one-piece unitary lid.

22. A container assembly comprising:

a container member including a main body member having an open end, said container member further including an annular skirt member spaced from and encircling at least a portion of said main body member adjacent said open end, said skirt member having an outer surface including a first outwardly directed thread, said main body member including a second inwardly directed thread; and a lid for closing said open end of said main body member, said lid including a first inwardly directed thread engageable with said first outwardly directed thread on said skirt member, and a second outwardly directed thread engageable with said second inwardly directed thread on said main body member, wherein said main body member includes a third outwardly directed thread, said lid includes a third inwardly directed thread engageable with said third outwardly directed thread on said main body member, and said third outwardly directed thread on said main body member is segmented and discontinuous.

23. A container assembly comprising:

a container member including a main body member having an open end, said container member further including an annular skirt member spaced from and encircling at least a portion of said main body member adjacent said open end, said skirt member having an outer surface including a first outwardly directed thread, said main body member including a second inwardly directed thread; and a lid for closing said open end of said main body member, said lid including a first inwardly directed thread engageable with said first outwardly directed thread on said skirt member, and a second outwardly directed thread engageable with said second inwardly directed thread on said main body member, further comprising a plurality of webs connecting said main body member to said skirt member.

24. A container assembly comprising:

a container member including a main body member having an open end, said container member further including an annular skirt member spaced from and encircling at least a portion of said main body member adjacent said open end, said skirt member having an outer surface including a first outwardly directed thread, said main body member including a second inwardly directed thread; and a lid for closing said open end of said main body member, said lid including a first inwardly directed thread engageable with said first outwardly directed thread on said skirt member, and a second outwardly directed thread engageable with said second inwardly directed thread on said main body member, wherein the first inwardly directed thread on said lid is non-rotatable with respect to said second outwardly directed thread on said lid.

* * * * *